US009260881B2

(12) United States Patent
Lamke

(10) Patent No.: US 9,260,881 B2
(45) Date of Patent: Feb. 16, 2016

(54) QUICK CAMP FRAME SYSTEM

(71) Applicant: HKD Global Limited, North Point (HK)

(72) Inventor: Samuel F. Lamke, Washington, MO (US)

(73) Assignee: HKD Global Limited, Hong Kong (HK)

( * ) Notice: Subject to any disclaimer, the term of this patent is extended or adjusted under 35 U.S.C. 154(b) by 0 days.

(21) Appl. No.: 14/210,961

(22) Filed: Mar. 14, 2014

(65) Prior Publication Data

US 2014/0261600 A1 Sep. 18, 2014

Related U.S. Application Data

(60) Provisional application No. 61/781,698, filed on Mar. 14, 2013, provisional application No. 61/817,432, filed on Apr. 30, 2013.

(51) Int. Cl.

| | |
|---|---|
| ***E04H 15/36*** | (2006.01) |
| ***E04H 15/48*** | (2006.01) |
| *E04H 15/32* | (2006.01) |

(52) U.S. Cl.

CPC ..... *E04H 15/36* (2013.01); *E04H 15/48* (2013.01); *E04H 2015/326* (2013.01)

(58) Field of Classification Search

CPC ..... E04H 15/36; E04H 15/40; E04H 15/42; E04H 15/48; E04H 2015/326; E04H 15/60

USPC ..... 135/123, 124, 127, 135–136, 156, 114, 135/901; 403/171–172

See application file for complete search history.

(56) References Cited

U.S. PATENT DOCUMENTS

| | | | | | |
|---|---|---|---|---|---|
| 3,223,098 | A | * | 12/1965 | Dole, Jr. | 135/126 |
| 3,730,544 | A | * | 5/1973 | Hyman | 280/819 |
| 3,834,410 | A | * | 9/1974 | Leibel | 135/123 |
| 4,201,237 | A | * | 5/1980 | Watts et al. | 135/98 |
| 4,590,956 | A | * | 5/1986 | Griesenbeck | 135/116 |
| 4,706,696 | A | * | 11/1987 | Gillis | 135/127 |
| 4,979,531 | A | | 12/1990 | Toor et al. | |
| 5,361,794 | A | * | 11/1994 | Brady | 135/147 |
| 5,450,703 | A | * | 9/1995 | Fuhrman et al. | 52/843 |
| 5,511,572 | A | * | 4/1996 | Carter | 135/145 |
| 5,634,483 | A | * | 6/1997 | Gwin | 135/131 |
| D533,914 | S | * | 12/2006 | Diaz | D21/839 |
| 8,776,813 | B2 | * | 7/2014 | DeLap et al. | 135/114 |
| 2008/0006317 | A1 | * | 1/2008 | Livacich et al. | 135/123 |

FOREIGN PATENT DOCUMENTS

| | | | |
|---|---|---|---|
| GB | 2365458 | A | 2/2002 |
| JP | 08284480 | A | 10/1996 |
| JP | 2003253915 | A | 9/2003 |
| WO | WO9858706 | A1 | 12/1998 |

* cited by examiner

*Primary Examiner* — Winnie Yip
(74) *Attorney, Agent, or Firm* — Polster Lieder

(57) ABSTRACT

A frame structure for a portable structure, preferably a tent, has a hub capable of a plurality of configurations, each configuration adapted for receiving an associated end of a tent pole. Preferably, the tent pole is formed from a plurality of tent pole sections. Each tent pole section has a first end and a second end. At least one end of each of said plurality of tent pole sections has a ferrule associated with it. The ferrule is sized to receive an adjacent end of an associated tent pole section. Preferably the ferrule has a frustoconical shape. The structure also includes feet for receiving an end of each tent pole. The hub, tent poles and feet all are attached to the material used to define the tent.

17 Claims, 4 Drawing Sheets

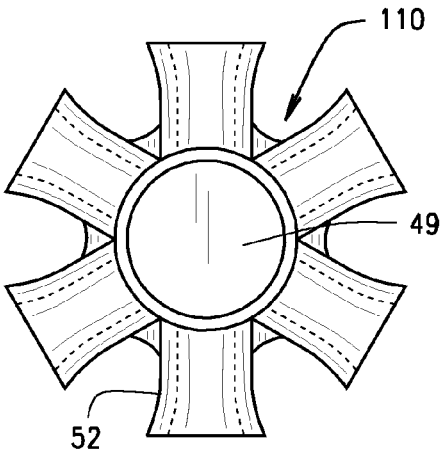
FIG. 7
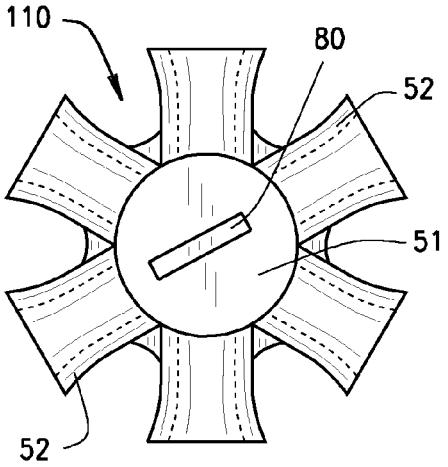
FIG. 8
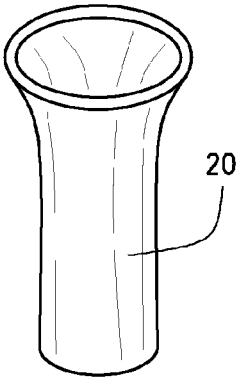
FIG. 11
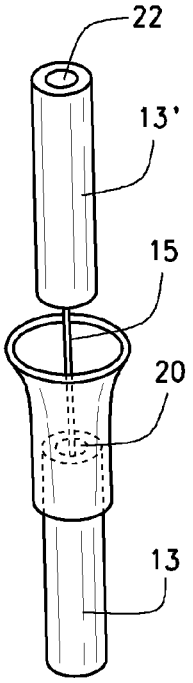
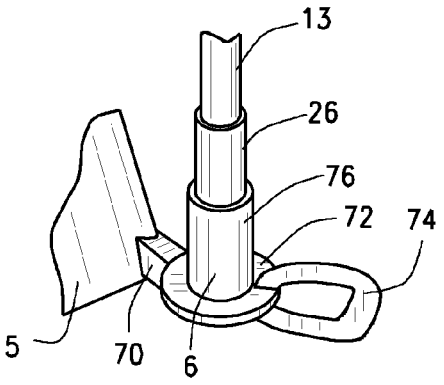
FIG. 13
FIG. 12

QUICK CAMP FRAME SYSTEM

CROSS REFERENCE TO RELATED APPLICATIONS

This application claims priority to U.S. Provisional Application No. 61/781,698 filed Mar. 14, 2013, and U.S. Provisional Application No. 61/817,432 filed Apr. 30, 2013, which are incorporated in their entirety by reference.

STATEMENT REGARDING FEDERALLY SPONSORED RESEARCH OR DEVELOPMENT

Not Applicable

BACKGROUND OF THE INVENTION

This disclosure is directed to portable structures. While the descriptions of various embodiments are concerned generally with camping tents, for example, those skilled in the art will recognize the wider applicability of the inventive features disclosed hereinafter.

The prior art is replete with tent constructions all allegedly making it easy to at least erect the tent structure. Among those constructions are self-erecting popup tents and umbrella tents, for example. While the art in general makes erecting the tent relatively easy, folding the tent for storage is not often accomplished with the same ease. In addition, cost of the various mechanism employed in the tent construction is an important consideration. That is to say, both the initial cost for the parts themselves and their assembly must be reasonable, and the ability to replace parts of the tent frame which may become damaged in use must be easy to accomplish for warranty purposes.

This disclosure describes in one illustrative embodiment the use of a hub structure having a plurality of tent poles removably interconnected to the hub structure on one end of at least some of the poles. Each of the tent poles are assembled from a plurality of pole sections. The pole sections are interconnected for assembly and disconnected for storage. In any event, the pole sections and consequently the tent poles have a suitable shock cord associated with them which extends through the associated hub and connects to the oppositely opposed tent pole to define a tent pole pair 14. Depending on the tent size and/or configuration, the hub may have two, four, six or more pole pairs associated with it. The pole sections preferably are fiberglass and one end of the pole section preferably is attached to a funnel ferrule. As indicated, the pole sections, funnel ferrule and hub all have the shock cord extending through or associated with them. In erecting the portable structure, the pole sections are first assembled to form the tent poles. One end of each tent pole is inserted in an associated ground engaging foot arrangement and the opposite tent pole end is inserted into the hub. A feature of the construction is that the frame structure always is attached to the material forming the portable structure, commonly a tent. In any event, the funnel ferrule accepts the fiberglass pole section easily. The foot assembly structure is also attached to the tent material and holds the frame in place for easy set up. Because pole sections are interchangeable across a variety of designs, height variations in the designs are easy to accomplish merely by adding or subtracting pole sections from the tent poles of a tent design. Other components of the frame structure remain the same for any particular frame structure combination. As will be appreciated, because all of the components of the frame system are always attached to the tent material, loss of component parts is eliminated while replacement of individual components of the frame is accomplished easily. The structure is easy to set up for use and disassemble for storage.

SUMMARY OF THE INVENTION

In accordance with this disclosure, generally stated, a frame structure system for a portable structure, preferably in the form of a tent, is provided having a flexible material attached to the frame structure. The flexible material forms the shape for the portable structure or tent. The frame structure system includes a hub having a plurality of tent poles interconnect with but removably attached to it. The hub as a plurality of receptacles formed to receive one end of an associated tent pole. The flexible material also is attached to the hub along an attachment structure associated with the hub. The tent poles and hub remain interconnected through associated shock cords extending between respective pairs of tent poles and the hub. Each of the tent poles preferably is formed by a plurality of pole sections. Certain of the pole sections have a first end having a ferrule associated with it and a second end. The flexible material has a plurality of feet attached to it. Each foot is adapted to accept the second end of at least one of the pole sections forming the tent pole. By proper selection of tent pole and feet interconnection, the portable structure is easily erected. The construction is adaptable to a variety of tent variations.

BRIEF DESCRIPTION OF THE SEVERAL VIEWS OF THE DRAWINGS

The objects of the invention are achieved as set forth in the illustrative embodiments shown in the drawings which form a part of the specification.

FIG. 7 is a top plan view of a third illustrative embodiment of a six way hub used in conjunction with additional portable structures not shown;

FIG. 8 is a bottom plan view of the six way hub shown in FIG. 7;

FIG. 11 is a view in perspective of one illustrative embodiment of funnel ferrule of the present disclosure;

FIG. 12 is a view in perspective of the funnel furrel shown in FIG. 11 illustrating one example of the interconnection of pole sections of the present disclosure; and FIG. 13 is a view in perspective of the interconnection of pole sections of the present disclosure and an associated tent foot for the embodiments shown in FIGS. 1 thru 4 of the present disclosure.

Figure 1:
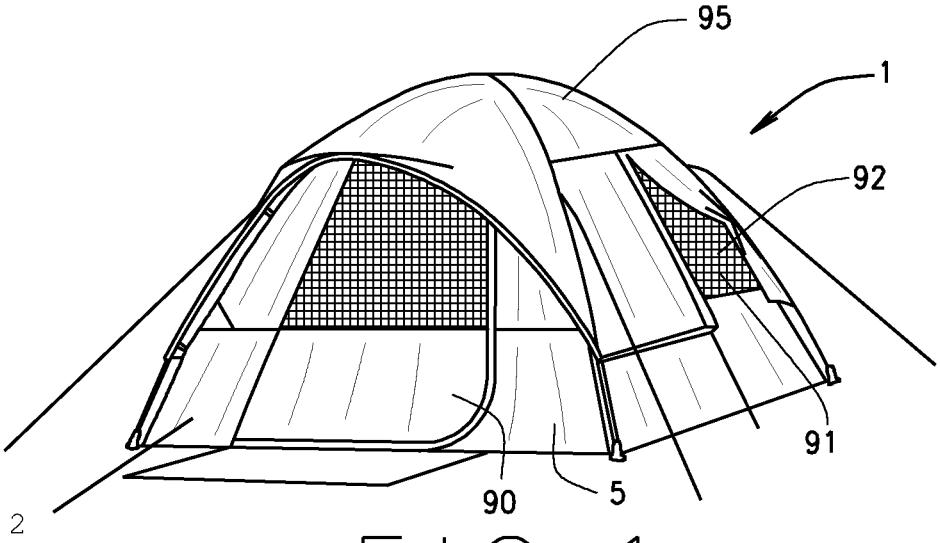
FIG. 1 is a view in perspective of one illustrative embodiment of tent frame structure showing use of a four way hub, foot and ferrule pole arrangement of the present disclosure.

Further aspects of the present disclosure will be in part apparent and in part pointed out below. It should be understood that various aspects of the disclosure may be implemented individually or in combination with one another. It should also be understood that the detailed description and drawings, while indicating certain exemplary embodiments, are intended for purposes of illustration only and should not be construed as limiting the scope of the disclosure.

DETAILED DESCRIPTION OF INVENTION

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention. Corresponding reference numerals refer to common structures where appropriate.

Figure 3:
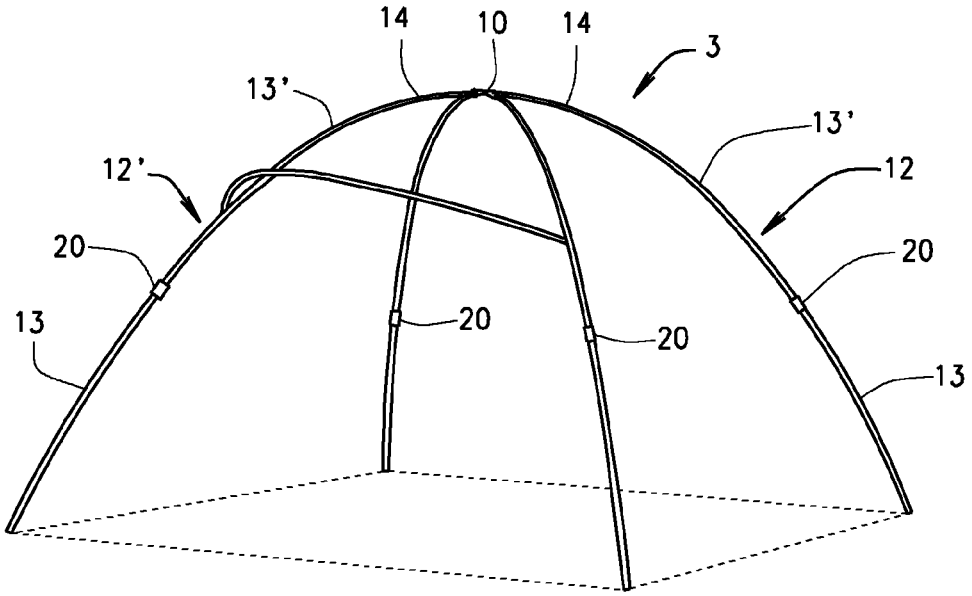
FIG. 3 is a view in perspective of a frame configuration used in conjunction with the portable structure shown in FIG. 1.

Referring now to FIG. 1, reference numeral 1 indicates one illustrative embodiment of portable structure of this disclosure. As shown in FIG. 1, the portable structure depicted preferably is a tent 2. As best seen in FIG. 3, a frame structure 3 for the tent 2 is constructed from a plurality of tent poles 12 which extended between a foot 6 and a hub structure 10. The physical appearance of the tent 2 is defined by tent material 5. As will be appreciated by those skilled in the art, the tent material 5 conventionally has an entrance door 90 formed in it and may be provided with windows 91 commonly closed by a suitable screen material 92. Conventionally, a fly 95 is positioned over the tent 2 to protect the interior of tent 2 from any adverse weather that may be encountered by a user of the tent 2.

Figure 4:
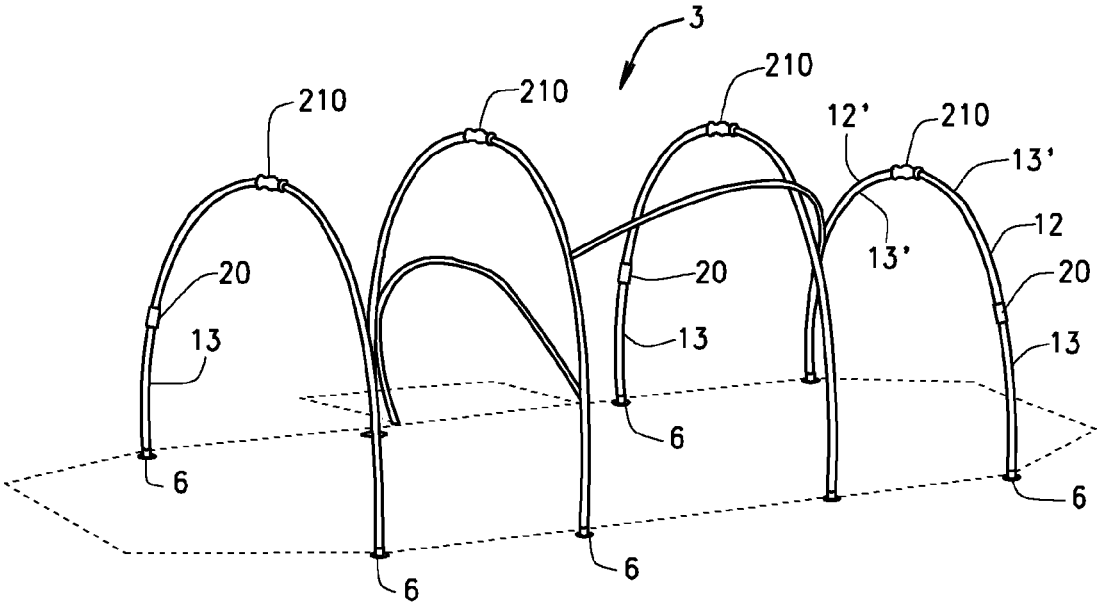
FIG. 4 is a view in perspective of a frame configuration used in conjunction with the portable structure shown in FIG. 2.

As illustratively shown in FIGS. 3 and 4, the tent poles 12 are formed by a pair of pole sections 13 and 13' which preferably are joined together along a ferrule 20. As used in this specification, a "ferrule" is used generically and can encompass a number of constructions, including the ferrule described below. Each of the pole sections 13, 13' are preferably constructed from fiberglass and are tubular structures having an axial opening 22 extending through them, sized to receive a shock cord 15. That is, each pole section 13 has a first end 26 preferably terminated along a metal ferrule 24. A second end of pole section 13 preferably is attached to the ferrule 20. The ferrule 20 is designed so that the respective ends of pole sections abut one another in the erected position of the portable structure 1. As will be appreciated by those skilled in the art, if desired, both ends of the pole section 13 may use a metal ferrule 24 for interconnection of the pole sections to form the tent pole 12. I have found that use of the funnel ferrule 20 speeds interconnection of the pole sections during setup and allows easy separation of the pole section during take down for storage. In like manner, the pole section 13' has a first end 30 attached to a metal ferrule 24 sized for reception in the hub 10. Other methods of interconnecting the pole sections will be apparent to those skilled in the art in light of the present disclosure. In any event, each pole 12 has an opposed pole 12' which also are connected by the shock cord 15. The shock cord 15 then extends from the pole sections 13, 13' through the hub 10 and through the pole sections 13, 13' of the tent pole 12'.

Figure 5:
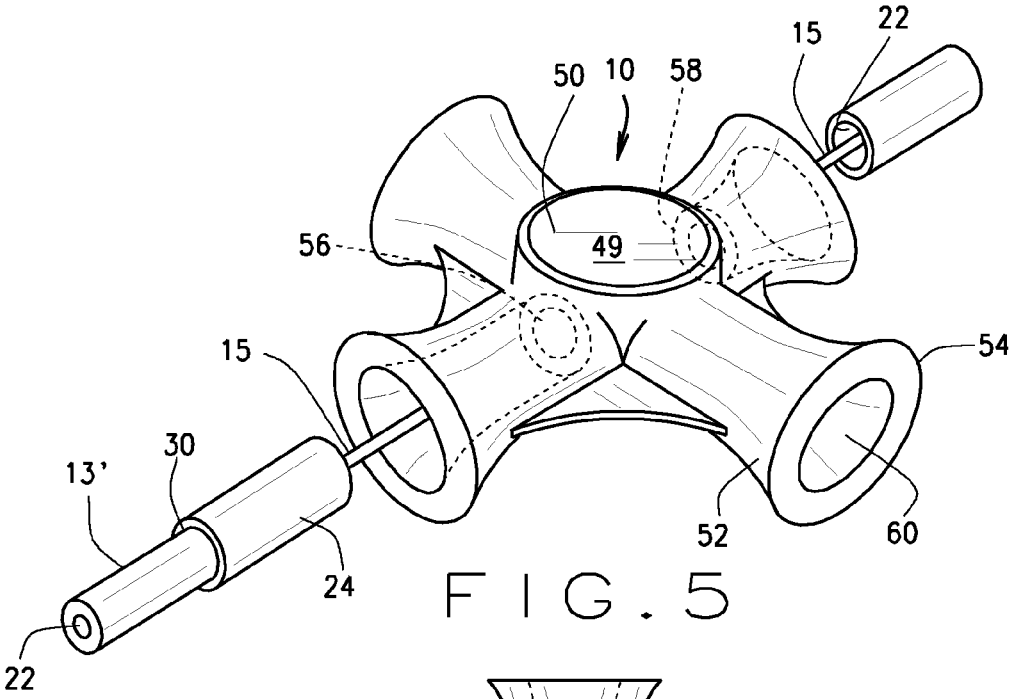
FIG. 5 is a view in perspective of one illustrative embodiment of a four way hub used in conjunction with the portable structure shown in FIG. 1.
Figure 6:
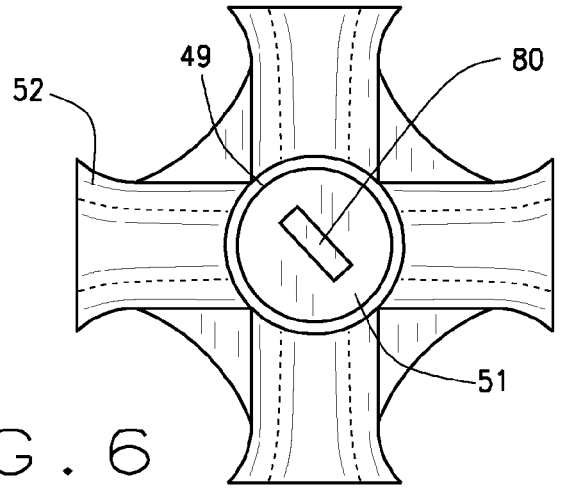
FIG. 6 is a bottom plan view of the four way hub shown in FIG. 5.

Hub 10, shown in FIGS. 5 and 6, has a central support 49 having a plurality of pole receiving arms 52 extending outwardly from it which act as receptors for the individual tent poles 12. The receiving arms are arranged in diametrically opposed relationship. The support has an upper surface 50 and a lower surface 51. The receiving arms 52 preferably are flared or frustoconical in shape for defining a channel 60 having a wide mouth 54 entrance and a narrow mouth exit 56. While the receiving arms 52 preferably are frustoconical, those skilled in the art will appreciate that other configurations are compatible with the broader aspects of the disclosure. For example, a more simple outwardly flared end functions similarly to the shape described above. The narrow mouth exit 56 is formed to define a stop 58 for engaging the end of the ferrule 24 of each of the tent poles 12 which, because of the relationship of the opposed receiving arms, also are in opposed relationship in the erected position of the portable structure 1. The channel 60 is part of a continuous passage through the hub 10 from one receiving arm 52 through the support 49 to and through to the oppositely opposed tent pole 12.

Figure 9:
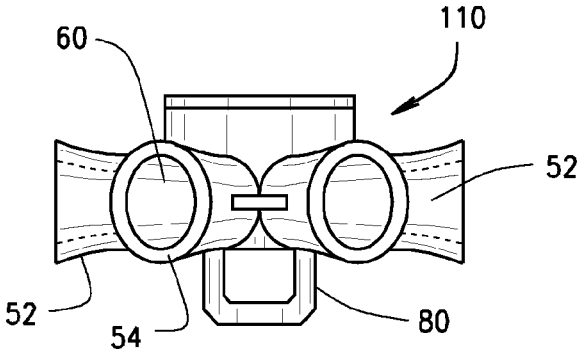
FIG. 9 is a view in side elevation of the six way hub shown in FIG. 7.

The lower surface 51 of the support 49 has an attachment structure 80 associated with it, best seen in FIGS. 6, 8 and 9. In the embodiments illustrated, the attachment structure 80 is a ring shaped design adapted to receive tie strings not shown for attaching the tent material 5 to the hub 10, for example. As described herein, each hub variation is attached to the tent material 5 in a similar manner. Other ways to attach the tent material 5 to a respective hub will be apparent to those skilled in the art. For example, hook and loop fasteners or hooks in various forms may be used to attach the respective hub to the associated tent material 5.

As indicated above, one of the associated hubs is shown in FIGS. 7-9. In this variation, three sets of oppositely opposed tent poles are employed in the portable structure 1 construction. In other aspects, the hub is similar in structure to the hub 10 described above and a detailed description is believed to be unnecessary.

Figure 2:
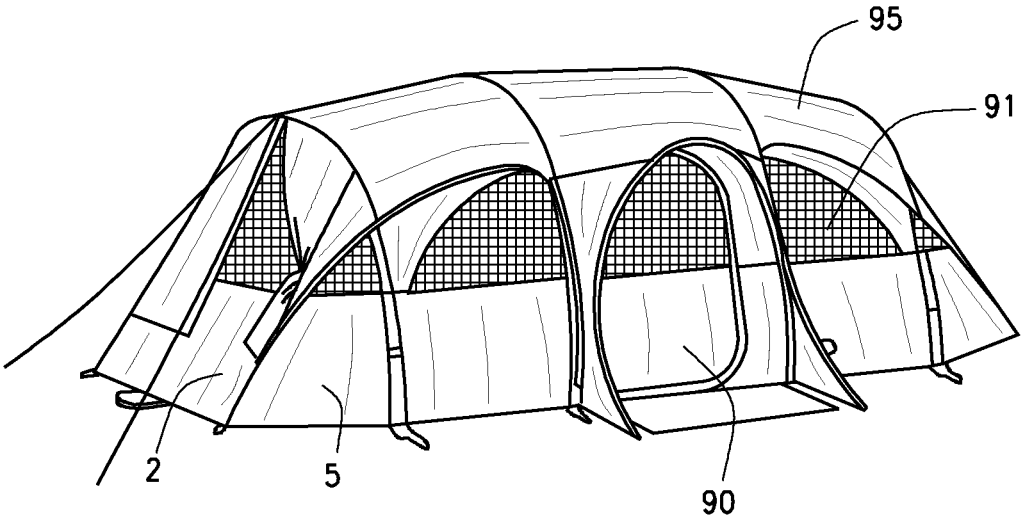
FIG. 2 is a view in perspective of a second illustrative embodiment of tent frame structure showing use of a two way hub, foot and ferrule pole arrangement of the present disclosure.
Figure 10:
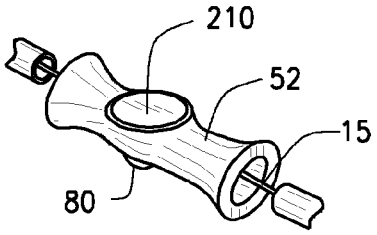
FIG. 10 is a view in perspective of one illustrative embodiment of two way hub shown in FIG. 2.

FIG. 10 illustrates a hub 210 used with one pair of opposed tent poles. This configuration is used in conjunction with the tent and frame structure of FIGS. 2 and 4. The hub 210 is designed to receive one set of oppositely opposed tent poles 12, 12'. A particular feature of the present disclosure is that the height of the portable structure 1 may be altered easily by adding additional pole sections to the tent pole to increase the length of the tent pole for example. In the alternative, a single section may be used to define the tent pole to reduce the height of a portion of the portable tent structure 1. Other similar variations will occur to those skilled in the art. In other respects, the hub 210 is similar in structure to the hub 10 described above and a detailed description is believed to be unnecessary.

FIG. 13 shows the attachment of pre-aligned feet 6 along the tent material 5 in conjunction with the tent pole 12 position. Attachment is accomplished by any convenient method. For example a strip of material 70 may be attached to the tent material 5 at one end of the strip and have a base unit 72 attached to it. The base unit 72, in the embodiment illustrated, also is attached to a stake down loop 74. The base unit 72 has a cylindrical receptacle 76 extending upwardly from it. The receptacle 76 defines a central opening sized to receive the end 26 of pole section 13 in a friction fit. The stake down loop 74 is used with associated tent stakes (not shown) to hold the portable structure in position. By aligning the position of the feet 6 properly with the position of the associated hub structure 10, 110 and 210 as appropriate, the structure is very easy to erect once the opposed tent poles are positioned in their respective feet. Preferably the feet 6 and tent poles 12 are color coded to insure proper orientation of the tent pole/feet during tent assembly by an end user.

As various changes could be made in the above constructions without departing from the scope of the invention, it is intended that all matter contained in the above description or shown in the accompanying drawings shall be interpreted as illustrative and not in a limiting sense. Numerous variations will occur to those skilled in the art in view of the forgoing description and accompanying drawings. Merely by way of example and not of limitation, the physical design of the hub structure may vary in other embodiments of the invention. While hub structures having three sets of opposed tent poles were discussed (not shown), hub structures having additional opposed tent poles are compatible with the broader aspects of the disclosure. Likewise, while various configurations were described as preferred, other configurations altered from the preferred designs will function with the scope of the appended claims. These variations are merely illustrative.

In view of the above, it will be seen that the several objects and advantages of the present invention have been achieved and other advantageous results have been obtained.

Having thus described the invention, what is claimed and desired to be secured by Letters Patent is:

1. A portable structure having a frame system, comprising:

a hub, the hub having a central support including at least one pair of oppositely opposed arms extending outwardly from the central support, each of the arms having a tent pole receiving receptacle formed in it, and a channel extending through the hub and communicating with an associated diametrically opposed receptacle extending outwardly from the central support;

at least one pair of tent poles, each of said tent poles having a first hub receiving end and a second end, each of said tent poles including a plurality of pole segments have a first end and a second end, a pole channel extending through [the first and second ends of ] each pole segment and said first and second ends, one of said first and said second ends of the pole segments defining a receiving end;

a ferrule receptor attached to the receiving end of said tent pole segments, the other of said first and second ends of the tent pole segments being sized for reception in the ferrule receptor of an adjacent tent pole segment, at least two of said tent pole segments defining one of the tent poles of said tent pole pair wherein the tent pole receptors and the ferrule receptors each have a flared outboard end for receiving the second end of said tent pole segment and said hub receiving end of said tent poles;

a shock cord associated with and extending continuously through, said pole channels of each of said opposed tent poles and said hub;

a plurality of feet for said portable structure, one of the feet plurality being associated with each respective one of the second end of said tent poles, each foot of the foot plurality having a channel formed in them, the channel of said feet defining a receptacle sized to receive a second end of an associated tent pole segment; and a cover material for defining the shape of the portable structure, the material having said hub and said feet attached to it;

wherein erecting the portable structure is accomplished by assembling the pole segments to form the tent poles, inserting the second end of each tent pole in an associated ground engaging foot and inserting the opposite hub receiving end of said tent pole into the hub.

2. The portable structure of claim 1 wherein the ferrule receptors have a frustoconical shape.

3. The portable structure of claim 2 wherein the frame system has a predetermined erected height determined in part by the length of the opposed tent pole pairs.

4. The portable structure of claim 3 wherein the height of the frame structure is altered by adding or subtracting tent pole segments defining the length of the respective opposed tent pole pairs.

5. The portable structure of claim 4 wherein the hub has a top surface and a bottom surface, the bottom surface incudes an attachment structure for attaching a tent material to said hub.

6. A portable structure having a frame system, comprising:

a hub, the hub having a central channel and at least one pair of oppositely opposed tent pole receptors formed in it, each of said oppositely opposed tent pole receptors communicating with one another through the central channel formed in said hub, the hub having first and second surfaces, at least said first and second surfaces having a tent material attachment device associated with it;

at least one pair of opposed tent poles, each of said tent poles having a hub receiving end and a second end, each of said tent poles including a plurality of tent pole segments, each segment having a first male end and a second female end, and a pole channel extending through and between the first male end of the second female end; a ferrule forming the second female end of said tent pole segment, the male end of each tent pole segment being sized for reception in a succeeding one of the female ends for successive connection, at least one of said tent pole segments defining the at least one tent pole, wherein the tent pole receptors and the ferrule each having a mouth sized to receive the male end of said tent pole segment and said hub receiving end of said tent poles;

a single shock cord extending continuously through the pole channels of each of said opposed tent poles and the central channel of said hub for foldably interconnecting the at least one pair of oppositley opposed tent poles and the hub together, the number of shock cords corresponding to the number of tent pole pairs;

a tent pole receiving foot associate with each end of the opposed tent pole pairs; and a tent material for defining the portable structure, the material having the hub and feet attached to it.

7. The frame system of claim 6 wherein the hub receptors have a frustoconical shape.

8. The frame system of claim 6 wherein the attachment device is integrally formed with the hub.

9. The frame system of claim 8 wherein the female end of the pole segments have a funnel shape.

10. The frame of claim 9 wherein the tent poles and tent feet are color coded.

11. The frame system of claim 8 wherein the tent material is attached to the hub along the attachment device.

12. A portable structure having a frame system, comprising:

a hub, the hub having a central support having a plurality of arms extending outwardly from the central support, each or the arms have a tent pole receiving receptacle formed in it, the receptacle defining a channel extending through the hub and communicating with a diametrically opposed receptacle extending outwardly from the support;

a plurality of tent poles removably connected with the hub along the receptacle of the arms, pairs of said tent poles being diametrically opposed to one another when interconnected with the hub; each tent pole having a pole channel passing therethrough, and the tent pole receptacles having a mouth sized for receiving an end of the tent pole; and at least a single shock cord extending continuously through the pole channels of the opposite tent poles and the channel of the hub for interconnecting pairs of said opposed tent poles through said hub, the number of shock cords corresponding to at least the number of opposed tent poles.

13. The frame system of claim 12 further including a tent material for defining the portable structure, the material having the hub attached to it.

14. The frame system of claim 13 further including a plurality of feet attached to the material, the number of feet correcting to the number of tent poles.

15. The frame system of claim 14 wherein the feet and tent poles are color coded to provide proper alignment of the tent poles and feet.

16. The frame system of claim 15 wherein the hub has an attachment structure integrally formed with it.

17. The frame system of claim 16 wherein the receptacle and mouth is frustoconical in shape.

* * * * *